United States Patent [19]

Littleton

[11] 4,426,897

[45] Jan. 24, 1984

[54] THERMAL ADJUSTMENT METHOD AND APPARATUS FOR ROTATING MACHINES

[76] Inventor: Francis J. Littleton, 182 McNair Rd., East Amherst, N.Y. 14221

[21] Appl. No.: 282,596

[22] Filed: Jul. 13, 1981

[51] Int. Cl.[3] ..... B26D 7/26

[52] U.S. Cl. ..... 83/37; 83/170; 83/344; 83/349; 83/700

[58] Field of Search ..... 83/13, 170, 171, 37, 83/349, 344, 700; 219/216, 221; 100/93 RP; 72/200

[56] References Cited

U.S. PATENT DOCUMENTS

| | | | |
|---|---|---|---|
| 1,972,133 | 9/1934 | Darrow | 83/171 X |
| 1,978,894 | 10/1934 | Clark | 83/171 X |
| 1,982,571 | 11/1934 | Clark | 83/171 X |
| 2,271,637 | 2/1942 | Garrison et al. | 83/171 X |
| 2,310,262 | 2/1943 | Shields | 101/407 |
| 2,312,726 | 3/1943 | Munro | 92/75 |
| 2,344,274 | 3/1944 | Stacom | 100/47 |
| 2,782,853 | 2/1957 | Heffelfinger | 83/170 X |
| 3,080,784 | 3/1963 | Schneider | 83/482 |
| 3,101,636 | 8/1963 | Schultz | 80/57 |
| 3,186,275 | 6/1965 | Obenshain | 83/349 X |
| 3,221,584 | 12/1965 | Novick | 83/170 |
| 3,509,815 | 5/1970 | Lloyd | 100/47 |
| 3,606,811 | 9/1971 | Hallden | 83/305 |
| 3,848,814 | 11/1974 | Syrjanen | 241/37 |
| 4,154,160 | 5/1979 | Kusters | 100/47 |
| 4,171,655 | 10/1979 | Voorhees | 83/344 |
| 4,218,943 | 8/1980 | Osburg | 83/304 |

FOREIGN PATENT DOCUMENTS

| | | |
|---|---|---|
| 2076191 | 10/1971 | France . |
| 2045474 | 10/1980 | United Kingdom . |

*Primary Examiner*—James M. Meister

*Attorney, Agent, or Firm*—Neuman, Williams, Anderson & Olson

[57] ABSTRACT

A method and apparatus for setting the positioning between a first rotating member and a second fixed or rotating member in a rotary machine comprises controlled thermal elements positioned on the frame supporting the members and/or on the rotating member(s) itself to counteract the effects of centrifugal force on the rotating member(s) to thereby approximately maintain the setting between the members. The temperature of the frame controlled by the thermal elements can be maintained in proportion to the speed of rotation of the rotary member(s) to maintain the setting of the rotary machine throughout its operating speed range. A predefined temperature may be set by the thermal elements prior to the manual setting of the rotary machine so that the temperature of the frame and/or rotating member(s) can be controlled to compensate for wear of the rotating member(s) in machines wherein such member(s) encounters wear over operating time.

7 Claims, 7 Drawing Figures

THERMAL ADJUSTMENT METHOD AND APPARATUS FOR ROTATING MACHINES

BACKGROUND OF THE INVENTION

This invention relates to rotating machines wherein a first rotating member is maintained in close physical relationship to a second fixed or rotating member and more particularly to a method and apparatus for thermally controlling the setting between the first and second members. While the invention is thus broadly applicable, it will be disclosed more fully with reference to the printing art to which it is particularly applicable.

For modern printing operations, a web of paper is fed into a printing press where it is passed between a pair of cylinders which print ink images on one or both sides of the web. In an offset press, which is selected as being representative of printing presses to which the present invention can be applied, these printing cylinders are called blanket cylinders. The blanket cylinders are precisely supported for rotation in a rigid frame which maintains a firm pressure between the cylinders. The ink images are transferred to the blanket cylinders by plate cylinders via techniques well known in the art and unimportant to the present invention.

Printing and ink transfer surfaces or plates of the blanket and plate cylinders respectively are clamped thereto by clamps positioned in slots or gaps which run the entire lengths of the cylinders. The positioning of the gaps and the synchronized rotation of the cylinders insures that the gaps come together or meet one another at common contact zones which are free of images to be printed. The meeting of the gaps as the cylinders pass through the common contact zones tends to cyclically change the loading on the cylinders, particularly the loading between the blanket cylinders which engage the paper web. That is, since the gaps are effectively flatened sections on the cylinders, the cylinders are somewhat unloaded as the gaps meet and pass by one another.

The repetitive load changes on the cylinders lead to rhythmic vibrations in the printing press. These vibrations can lead to inking problems which appear as streaks across pages printed on the press and are generally encountered as the speed of the press is increased toward the maximum. In the past, streaking problems have been attacked by stiffening the cylinders to attempt to reduce the vibrations and accordingly the ink streaks. These efforts have been only marginally successful to allow somewhat higher press operating speeds before streaking occurs.

After the web of paper has been printed, it is passed to various other machines, for example to a dryer and/or a chill roll device, before it is cut and folded, sheeted or otherwise further processed. Rotary cutters or perforators are generally used to sever or punch the webs of paper moving through the printing machinery to produce or define individual sheets along the web and/or to trim away waste.

Rotary cutters and perforators are generally constructed by providing for the rotation of a first member having one or more cutting surfaces, punches or perforators which are disposed relative to a second member to sever or punch a paper web moving between the two members as the first member is rotated. The second member may be a fixed knife or anvil having a single cutting surface past which the cutting surfaces of the first member are rotated. The second member may also be rotated and comprise a rotary knife or anvil. A rotary anvil would have a hardened outer cylindrical surface to interface with the cutting surfaces of the first member. Multiple cutting surfaces provided on the rotating first member are spaced about the circumference of the circle traced by rotation of the cutting surfaces to form sheets of equal sizes or to trim away waste portions of the web.

In any event, the spacing between the first member and the second member must be carefully and precisely set to both obtain a proper cut or perforation of the paper web and to avoid damage to the cutting surfaces. Accordingly, both members are supported at their ends in a single rigid framework which provides bearing surfaces for rotating members and permits adjustment of the members relative to one another. Such adjustment is typically made by jacking screws, shims or by eccentric adjustment apparatus such as disclosed in U.S. Pat. No. 4,171,655.

An operator precisely sets the rest position of the members relative to one another so that precise cuts or perforations of the web are made. Such static setting of rotary cutters and perforators is adequate for relatively low speed operation. However, this setting will often change during operation. On one hand, as the speed of rotation increases to higher and higher speeds, such as is possible with improved technology in associated equipment such as printing presses, the setting between the members will change due to centrifugal force which tends to cause the effective radius to the cutting surface(s) of the rotating member (or members) to increase or "grow". This tends to reduce the clearance between the cutting surfaces. On the other hand, wear tends to reduce the effective radius of the members which tends to increase the clearance. In recently set cutters/perforators, the growth tends to cause the cutting surfaces to grow closer and closer to one another and ultimately may result in contact which can dull the cutting surfaces or even lead to breakage. Since the wear and growth bear no correlation to one another, they therefore do not compensate for each other and the quality of the cut made by the rotary cutter/perforator is impaired with both increased speed and lengthy operation.

Available mechanical adjustments of the settings of the members relative to one another are complex and/or require continuous manual adjustment. Such adjustable setting arrangements are both time consuming, potentially inaccurate and are not easily adaptable to existing rotary cutters/perforators.

SUMMARY OF THE INVENTION

In accordance with the present invention, the problems involved with the adjustment of a first rotating member relative to a second member while operating a rotating machine including both members are overcome by a method and apparatus for thermally controlling the setting between the members. The rotating machine includes an operating member having a longitudinal axis and being mounted for rotation about its axis in a supporting frame. A cooperating member, which may be either fixed or rotatable, is also mounted within the frame and disposed relative to the operating member so that an operation, such as printing, cutting or perforating, is performed on a web of material as the operating element is rotated and the web is moved between the operating and cooperating members. The position of the operating member relative to the cooperating member is adjusted by thermal control of portions of the frame which extend between the mounting points for the operating and cooperating members.

As applied to a printing press, the pressure between a printing cylinder and a back up cylinder can be controlled by thermal adjusting apparatus operating on the frame which supports the cylinders. The thermal control is applied to the frame between the supported portions of the cylinders. Similar thermal control elements can be used to adjust the frame dimensions between all rotating cylinders comprising a printing press, for example the plate and blanket cylinders in an offset press.

As applied to rotary cutters or perforators, the present invention comprises first and second members supported in a frame with at least one of the members being rotatable and disposed relative to the other member to provide cutting or perforating spacing between the members. Thermal adjusting elements are provided for setting the spacing between the members by controlling the temperature of portions of the frame which extend between supported ends of the members.

Additional adjustment can be provided by thermal control elements mounted on the rotating member between an axis of rotation and a cutting surface(s) with electrical control signals passed to the elements by means of sliding contacts. Thermal control of the rotating element is particularly desirable in elements having multiple cutting surfaces to precisely adjust each of the individual cutting surfaces.

A method of operating a rotary machine in accordance with the present invention is to be applied to apparatus comprising a frame having first and second support portions, an operating member mounted on the support portions for rotation, a cooperating member mounted on the support portions and disposed relative to the operating member so that printing, cutting or perforating is performed on a web of material as it passes between the operating and cooperating members and the operating member is rotated. The method comprises the steps of setting the position of the operating and cooperating members on the frame, fixing the position of the operating and cooperating members relative to the frame, rotating the operating member to perform the operation and controlling the temperature of the first and second support portions to approximately maintain the setting between the operating and cooperating members during operation of the rotary machine. The temperature control can be coordinated or synchronized with the speed of rotation of the machine by controlling the temperature in proportion to that speed of rotation. Such coordination can be accomplished by monitoring the speed of rotation of the operating member, translating that speed of rotation into a desired temperature for the first and second support portions, monitoring the temperature of the first and second support portions and controlling thermal elements mounted on the first and second support portions to maintain their temperatures at approximately the desired temperature. The step of initially setting the position of the operating and cooperating members can be performed at a predefined temperature which can differ between the two support portions to obtain an initial precision setting between the members.

In accordance with one aspect of the present invention, settings between a first rotating member and a second fixed or rotating member of a machine can be approximately maintained and synchronized to the speed of rotation of the rotating member(s). Settings between a plurality of rotating members, such as in an offset printing press, can be similarly maintained.

In accordance with another aspect of the present invention when applied to a machine with rotating member(s) which tend to wear down, such as a rotary cutter or perforator, the relation between the members can be initially set in a prebiased condition with a predetermined temperature differential from ambient, e.g., with the thermal control elements at predefined elevated temperatures. Adjustment means are provided to independently set the initial prebias temperature of the individual thermal control elements to provide for ease of setting the members relative to one another. The prebias temperatures must be maintained during start-up of the machine to avoid damage to the members which might otherwise contact one another. After start up, the temperature of the thermal elements is controlled relative to the prebiased temperature to counteract the effect of radial length changes as the operating speed of the machine changes. Prebiasing of the initial setting of the members allows reduction of the spacing between the members by reduction of the prebias temperature setting during operation of the rotary machine to compensate for wear of the members with time.

Advantageously, thermal elements used to set spacing for rotary members can be easily controlled via electrical signals to provide for minute adjustments in the positioning of the members relative to one another. Such thermal control can also be coordinated or synchronized with the speed of rotation of the rotary machine to maintain high performance throughout the speed range of the rotary machine and can be adjusted to compensate for wear where appropriate. Such minute adjustments help prevent damage to rotary members which are adjusted to compensate for wear during operation of the machine.

BRIEF DESCRIPTION OF THE DRAWING

The invention of the present application will be better understood from a review of the detailed description of the illustrative embodiments with reference to the drawing in which.

Figure 1:
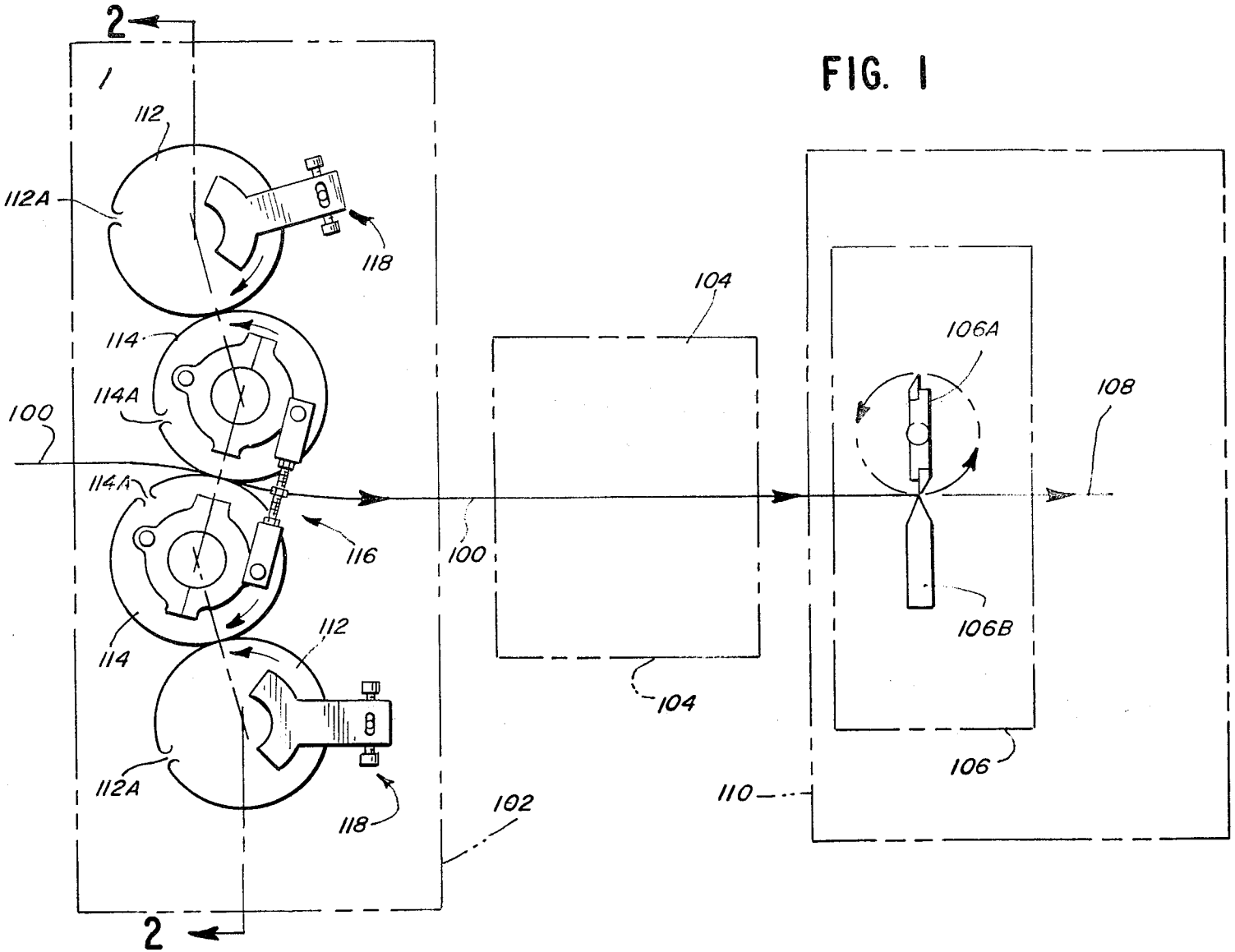
FIG. 1 is a schematic diagram showing paper flow through a printing system.

It is to be understood that the drawing figures are not drawn to exact scale and that portions of the apparatus have been omitted from various drawing figures for clarity and ease of understanding.

DETAILED DESCRIPTION OF THE ILLUSTRATIVE EMBODIMENTS

FIG. 1 shows schematically an offset printing operation wherein a web of paper 100 is passed through an offset printing press 102 which is shown as a single printing stage or station, however typically would comprise several printing stages. The paper web 100 is passed from the printing press 102 through a variety of postprinting equipment such as a dryer and/or chill rolls indicated generally at 104. The web 100 is next fed through a rotary cutter 106 where the web 100 is intermittently severed to form sheets or pages 108, which pages may comprise one or more sheets of printed material. The rotary cutter 106 may, for example, be a part of a sheeter 110 such as that illustrated in U.S. Pat. No. 3,994,221.

In the offset printing process, the equipment for each printing stage or station includes a pair of inked plate cylinders 112, each carrying ink images of matter to be printed on the two sides of the paper web 100 and two offset or blanket cylinders 114 for transferring the ink images from the plate cylinders to the paper in the desired registry. The transfer surfaces on the blanket cylinders 114 are provided by sheets or blankets wrapped around the cylinders and secured thereto by suitable clamping means (not shown) disposed in transverse slots or gaps 114A extending throughout the length of the cylinders. During the actual printing operation, the two blanket cylinders also serve as backing or impression cylinders each for the other, the moving web 100 engaging both in a common transverse contact zone so that both sides of the web are printed at the same time. The two blanket cylinders 114 are phased so that the blanket joints or gaps 114A of both revolve through the common contact zone and in registry with the spacing or transverse border area between successive printings or signatures.

Sheets or plates containing the impression to be printed onto the paper web 100 are similarly wrapped around the plate cylinders 112 and secured thereto by suitable clamping means (not shown) disposed in transverse slots or gaps 112A which similarly extend throughout the lengths of the plate cylinders 112. The blanket and plate cylinders 112, 114 are phased so that the blanket joints or gaps 114A and the plate joints or gaps 112A of the blanket and plate cylinders similarly revolve through a common contact zone and in registry with the spacing or transverse border area between successive printings or signatures.

The impression pressure between the blanket cylinders 114 can be set in a variety of ways well known in the art, such as by adjustment screws and apparatus 116. Similarly, the impression pressure between the blanket cylinders 114 and the plate cylinders 112 can be set in a variety of ways well known in the art, such as by adjustment screws and brackets 118. In existing printing presses, the impression pressure between the blanket cylinders and between the blanket cylinders and the plate cylinders is set while the printing press is at rest.

Figure 2:
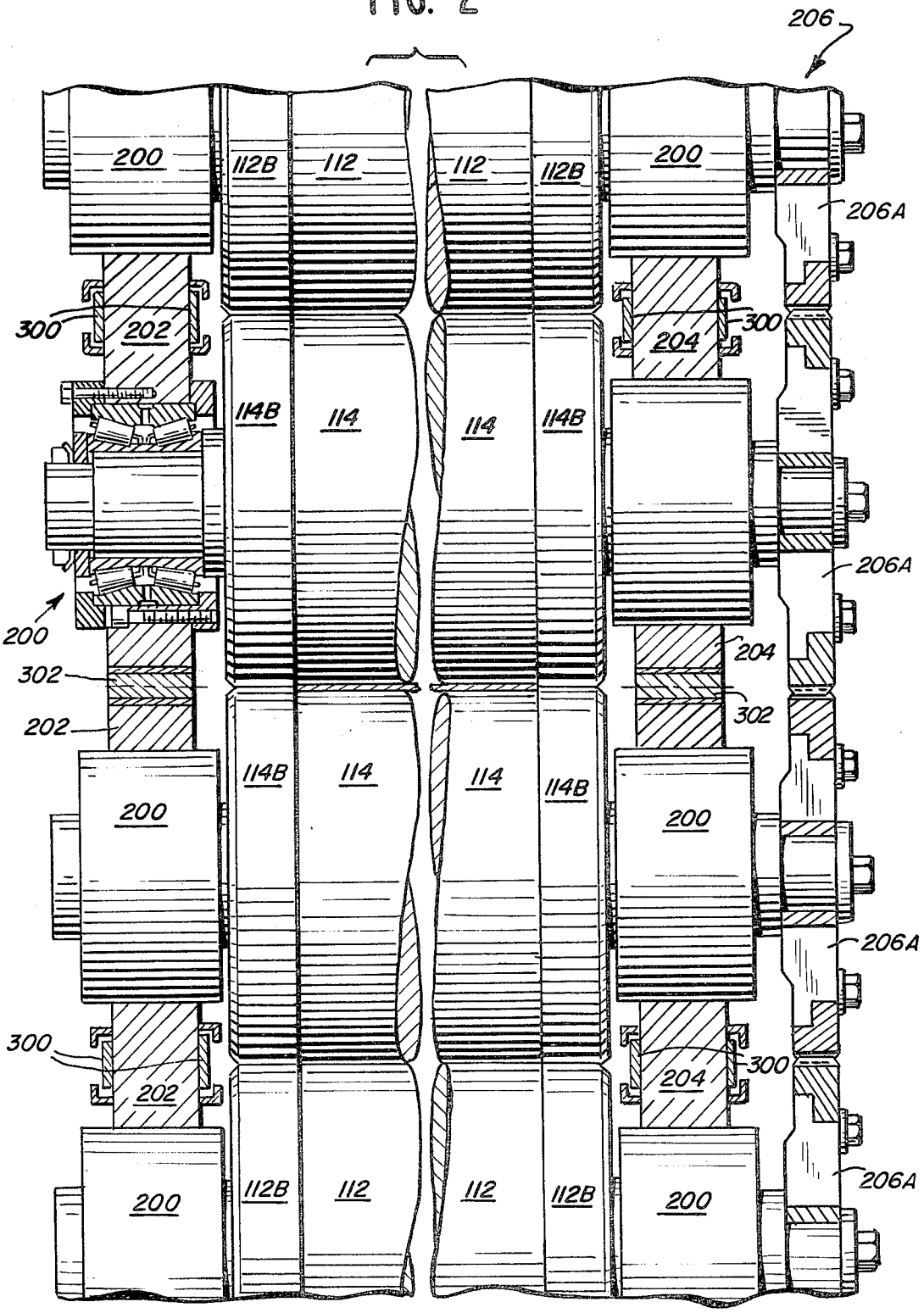
FIG. 2 is a partially sectioned view of the printing press of FIG. 1 taken along the line 2—2 in FIG. 1.

FIG. 2 shows a partially sectioned view through the blanket and plate cylinders and the supporting sidewalls of the printing press 102 taken along line 2—2 shown in FIG. 1. Although the bearings 200 are adjustable relative to one another by various means known in the art, they are shown for ease of illustration in FIG. 2 as being fixed into the side frames 202 and 204 which is effectively the case after the impression pressures have been set.

The blanket cylinders 114 may include bearers 114B and the plate cylinders 112 may include bearers 112B dependent upon press design. If bearers are provided in the printing press, the bearers 112B and 114B engage one another as shown in FIG. 2 to maintain the impression pressures between the plate cylinders and blanket cylinders and between the blanket cylinders. The plate cylinders 112 and the blanket cylinders 114 are slightly undercut from their associated bearers 112B and 114B respectively to provide defined spacing between the central portions of the cylinders to allow for the printing blankets and plates to be wrapped around their respective cylinders. The plate and blanket cylinders are synchronized with one another through a gear train 206 comprising the individual gears 206A which are driven from the press drive system.

The bearers 112B and 114B are forced tightly against one another to maintain the proper spacing between the blanket and plate cylinders such that high quality printed material can be produced on the printing press 102. The initial adjustment of the impression pressures is adequate for lower printing press speeds. However, as the speed of the press increases, problems in print quality arise due to the increased speed. In particular, streaks of ink may appear in groupings across the paper web as material is printed thereon. Apparently, these streaks result as the effect of vibrations which are created due to the loading and unloading of the blanket cylinders 114 due to the mating of the blanket cylinder gaps 114A as the blanket cylinders rotate one against the other. Similar vibrations are also set up by the plate cylinder gaps 112A mating with the blanket cylinder gaps 114A.

In the past, attempts to overcome such vibrations have been by rigidifying the plate and blanket cylinders. Indeed, such rigidifying techniques of the plate and blanket cylinders do tend to marginally improve the performance of printing presses; however, streaking still occurs at higher speeds.

In conjunction with the present invention, it has been discovered that the problem of vibration and flexing of the plate and blanket cylinders at high speed operation are increased by the centrifugal force and the heating of the bearers and/or cylinders to cause streaking at lower speeds than would otherwise be encountered if the impression pressures of cylinders 112, 114 were set to counteract increases in radial dimensions due to the centrifugal forces and heating. In particular, as the blanket and plate cylinders 112, 114 rotate one against the other, the cylinders 112, 114 as well as the bearers 112B, 114B in presses so equipped, tend to grow along their radial dimension whereas the positions of the bearings 200 in the side frames 202 and 204 of the press are maintained constant as adjusted with the press at rest speed. This expansion of the cylinders, particularly in presses having bearers, causes bowing of the cylinders which increases the vibrations created by the loading and unloading caused by the cylinder gaps 112A, 114A passing by one another. Also, as the bearers 112B, 114B are pressed more and more tightly together due to the centrifugal forces created by high speed operation, the temperature of the bearers tends to increase causing further expansion and bowing of the cylinders thus further increasing the vibrational forces at higher speeds.

With the present invention, such problems created by the "growth" of the cylinders and bearers (if provided) are eliminated by controlling the temperature of the sections of the frames 202 and 204 located between the bearings 200 supportinig the plate and blanket cylinders. In the illustrative embodiments, these frame sections are constructed from a material having a positive coefficient of thermal expansion since heating elements are used for the thermal control. By controlling the temperature of the frame portions separating these bearing points, the frame dimensions can be increased or "grown" by thermal expansion of those portions of the frame by an amount approximately equal to the growth of the cylinders due to centrifugal force and heating.

Figure 3:
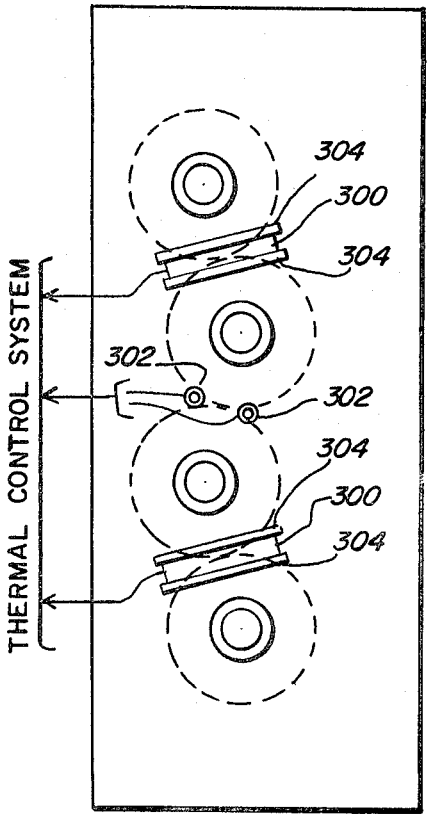
FIG. 3 is a side view of the printing press of FIG. 1 taken from the left in FIG. 2.

By way of example, the portions of the framework separating the bearings which support the cylinders are controlled by thermal heating elements shown in FIGS. 2 and 3 as either strip heaters 300 positioned on either side of the frame or circular heating elements 302 which are inserted into small holes drilled either partially or totally through the supporting framework. The strip heaters 300 are held in place by flanges 304 or by other appropriate supports. Press frames are generally constructed of steel and are of substantial rigidity and strength so that holes drilled to receive heating elements 302 should not effect the strength of the support members.

The positioning of the heating elements is best seen in FIG. 3 as being oriented along a line generally normal to the line interconnecting the centers of the associated cylinders which are effected by the heating elements. As shown in FIG. 3, two cylindrical heating elements 302 are shown as being positioned between the two blanket cylinders. Strip heaters 300 are shown as being positioned between the blanket to plate cylinders. It is not necessary to maintain the entire frame at the temperatures required to "grow" the frame. The temperature of the portions of the frame centered between any two cylinders can be adequately controlled to produce the dimensional changes required to compensate for the centrifugal and heat growth produced by high speed operation of the printing press. Although strip heaters and cylindrical heaters have been disclosed, other types of heating apparatus or temperature control apparatus can be used in accordance with the present invention.

A similar problem is encountered in the rotary cutter 106 which serves to sever the web 100 into individual sheets or pages 108. The rotary cutter 106 comprises a rotating knife 106A which can comprise one or more cutting surfaces and, as shown in the illustrative embodiment, comprises two cutting surfaces or edges 106C, see FIGS. 4 and 5. The position of the rotating knife 106A is adjusted relative to the fixed knife 106B by conventional mechanical apparatus (not shown) so that the cutting edges 106C of the rotary knife 106A pass closely to or just touch the cutting edge 106D of the fixed knife 106B. The paper web 100 passing through the rotary cutter 106 is severed into sheets 108 as the rotating knife 106A rotates. As the speed of the web 100 passing through the printing press 102 and the apparatus 104 is increased, the speed of rotation of the rotating knife 106A must be similarly increased in synchronism so that the sheets 108 remain the same size and are accurately severed at appropriate points along the web to form desired sheets and/or trim away waste material from the web.

In the prior art, rotary cutters have been adjusted at rest so that the cutting surfaces 106C of the rotating knife 106A are parallel to the cutting surface 106D of the fixed knife 106B and pass sufficiently close to one another to sever the paper web 100 as it passes through the rotary cutter 106 but avoid damage to the blades. The adjustment of the rotating knife 106A relative to the fixed knife 106B has typically been by jacking screws or by mechanically actuatable eccentric mechanisms. It is totally impractical to adjust the rotating blade 106A by means of jacking screws after the cutter has been activated. Various mechanical prior art arrangements, such as movable eccentric mountings for the rotating knife 106A, allow adjustment of that knife relative to the fixed knife 106B. However, such prior art arrangements are mechanically complicated and require precision machining to insure that the adjustment of the knives is made in minute increments to minimize the possibility of damage to the knives if they are adjusted while the rotary cutter is operating.

Fixed adjustments are satisfactory if the rotation speed of the rotary knife 106A is sufficiently slow that no substantial increase in knife radial dimensions due to centrifugal force is encountered. However, as the rotary cutter 106 is operated at higher and higher rotational speeds, the rotating knife 106A does tend to "grow" due to centrifugal force. The rotating knife 106A may then have substantial contact with the fixed knife 106B leading to dulling and possible breakage of the cutting surfaces 106C, 106D and consequent unsatisfactory cutting of the web 100. Such wear requires the entire printing operation to be shut down until the knives can be readjusted or replaced with the consequent high costs of lost time and increased labor. It is noted that similar problems are encountered in perforators wherein a rotating member with one or more punches or perforators would replace the rotating knife 106A and a fixed or rotary anvil would replace the fixed knife 106B.

Figure 5:
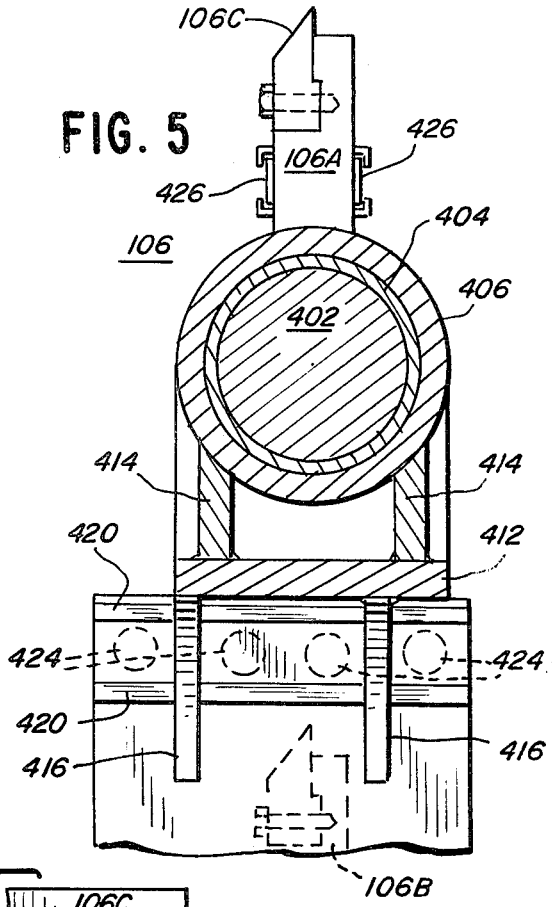
FIG. 5 is an end view of the cutter of FIG. 4.
Figure 4:
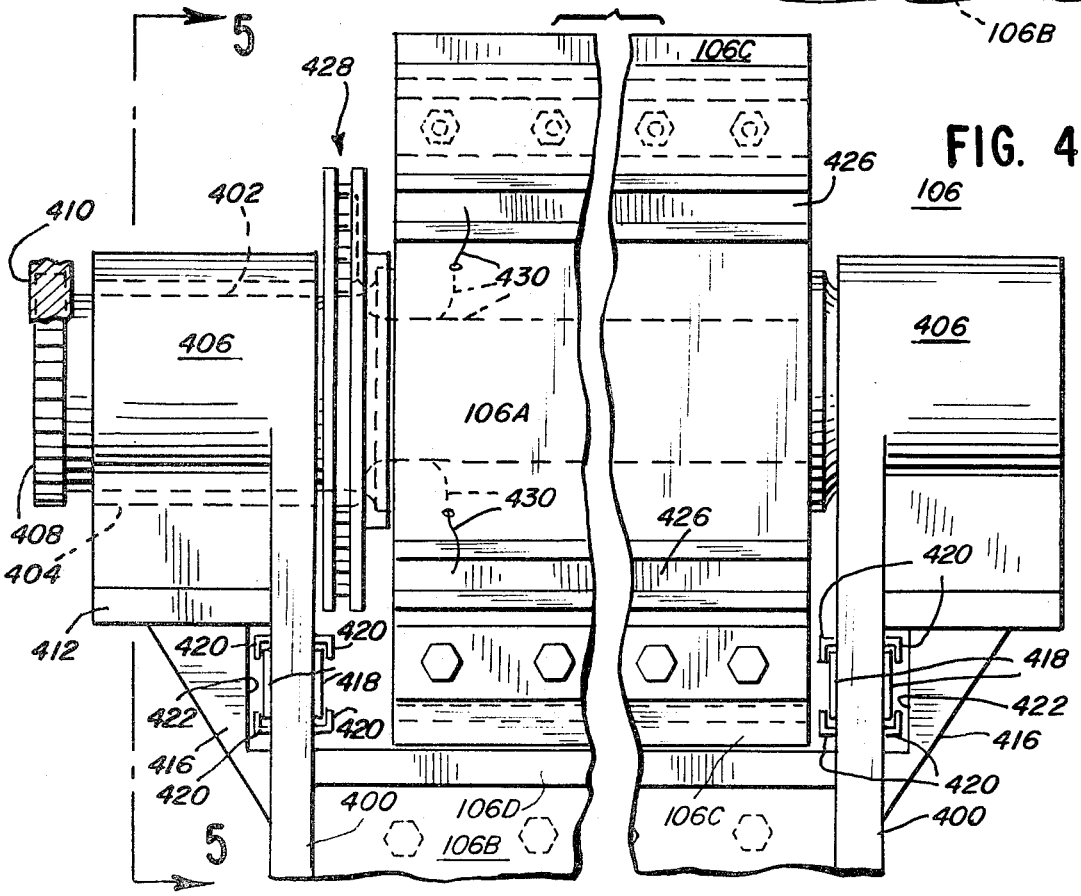
FIG. 4 is a front view of the rotary cutter of FIG. 1.

FIGS. 4 and 5 show a rotary cutter 106 wherein the height of the rotating knife 106A is adjusted not only by jacking screws or eccentric devices in accordance with the prior art, but, in accordance with the present invention, is also adjusted by thermal control of vertical support elements 400 which extend between the fixed knife 106B and the bearings 404 which support the ends of the rotating knife 106A. The rotating knife 106A includes journals 402 which are supported for rotation within the bearings 404 and enclosed within a housing 406 which is in turn supported on the upper end of the vertical support elements 400. A drive gear 408 is securely affixed to one journal 402 for driving the rotary knife 106A. The gear 408 is engaged by a drive gear 410 associated with the printing press 102 to synchronize the rotational speed of the rotating knife 106A with the operating speed of the printing press 102. A base plate 412 and strengthening members 414 tend to stiffen and strengthen the generally cylindrical housing 406 which supports the journals 402 for rotation of the rotating knife 106A. The base plate 412 is further supported by angled brackets 416 which are welded or otherwise firmly connected between the base plate 412 and the vertical supports 400.

The temperature of the section of the vertical support 400 extending between the fixed knife 106B and the generally cylindrical housing 406 supporting the rotating knife 106A is controlled by thermal elements 418 shown in FIGS. 4 and 5 as being strip heater elements and being supported on either side of the vertical support member 400 within flange members 420. The angular support braces 416 have apertures 422 for receiving the thermal elements 418. As shown in FIG. 5, cylindrical heating elements 424 could alternately be used in the vertical supports 400. The cylindrical heating elements 424 are inserted into circular holes extending at least part way through the vertical supports 400. Although four circular heating elements 424 are illustrated, any reasonable number of heating elements could be utilized from a single heating element to a reasonable number greater than four. The number of circular heating elements 424 depending on requirements such as desired response time and consequential weakening of the vertical supports 400 by their installation. The use of strip or circular heating elements facilitates the modification of existing rotary cutters to utilize thermal control in accordance with the present invention. Of course, any other form of thermal control element could be reasonably applied in accordance with the present invention.

The thermal elements must be positioned to control the temperature of the support members between the fixed knife 106B and the rotary knife 106A. However, the exact positioning of the thermal elements as shown in the illustrative embodiment is not critical and will depend upon the structure of the support members which can be designed or, in existing machines, adapted to best receive the thermal elements.

Adjustment of the cutting edges 106C of the rotating knife 106A to the cutting edges 106D of the fixed knife 106B can be further controlled in accordance with the present invention by attaching thermal control elements 426 to the rotating knife 106A. Electrical power is conducted to the thermal elements 426 via well known commercially available brushes and slip rings indicated generally at 428. The conductors 430 going to the thermal elements 426 can be routed through one (as shown) or both of the journals 402 of the rotating knife 106A and passed to the heating elements 426 via surface strip wiring or radial channels and insulated wires 430 as shown in FIG. 4. Two, three or more thermal elements 426 are mounted across the width of the rotating knife 106A for each cutting surface 106C. Each of the thermal elements 426 can be independently controlled for each cutting surface 106C to extend or retract the respective adjacent portion of the cutting surface relative to the cutting surface 106D of the fixed knife 106B, e.g., to maintain the cutting surfaces of the knives in parallel relationship to one another.

Figure 6:
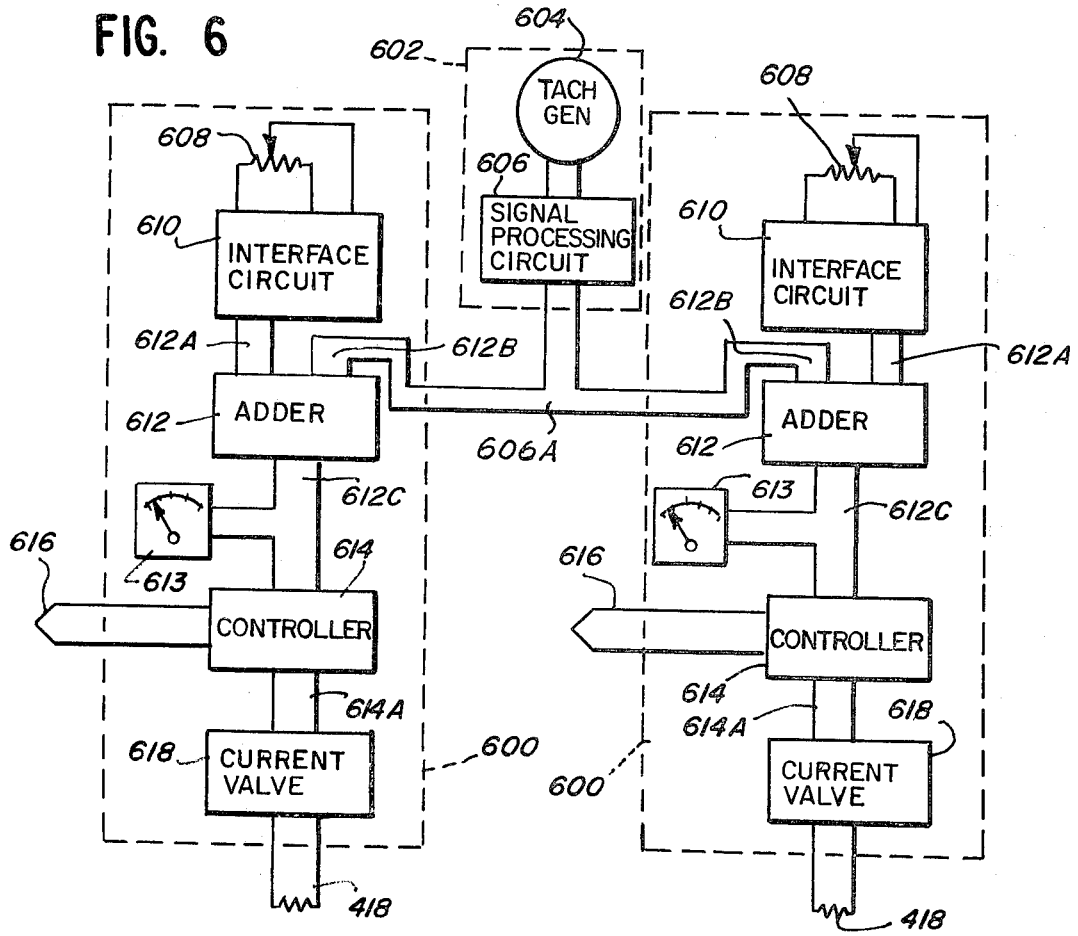
FIG. 6 is a block diagram of a thermal control system for use in the present invention.

A block diagram of an exemplary thermal control system for controlling thermal elements used in the present invention is shown in FIG. 6. The thermal control system of FIG. 6 will be described with reference to the rotary cutter 106 and more particularly to controllng the thermal elements 418 or 424 associated with the vertical support members 400. The thermal control system provides for coordination of the temperature settings for the support members 400 of the rotary cutter 106 with the rotation speed of the rotary knife 106A. Of course the speed of rotation of the rotary knife 106A corresponds to the speed of operation of the associated equipment, such as the printing press 102.

A thermal control unit 600 is associated with the thermal heating elements 418 (424) of each vertical support 400. The control units 600 are in turn driven by a speed coordinating or synchronizing control unit 602 which comprises a tachometer/generator 604 or other speed indicating signal generator and a signal processing circuit 606. The output signal from the tachometer/generator 604 is typically a relatively large direct current signal varying from 0 to 100 volts which is not compatible with the signal levels of the other components of the control system. The signal processing circuit 606 reduces or converts the output signal from the tachometer/generator 604 to a signal level which can be used. The tachometer/generator 604 is driven by the drive system of the printing press 102 to reflect the speed of operation of the printing system and, accordingly, the speed of rotation of the rotary cutter 106.

Each thermal control unit 600 comprises a potentiometer 608 which can be adjusted to present a varying resistance within a defined resistance range for the selected potentiometer. A direct current signal representative of the resistance presented by the potentiometer 608 is generated by an interface circuit 610 and passed to a first input 612A of an adder circuit 612. The adder circuit 612 generates an output signal on its output 612C which is the algebraic sum of the input signals on inputs 612A and 612B. The input signal to the input 612B of the adder circuit 612 is generated by the conditioning circuit 606 to coordinate the temperature of the support elements with the speed of rotation of the rotary machine as will be described hereinafter.

The output signal of the adder circuit 612 is passed to a controller 614 which also receives temperature input signals indicative of the temperature of the member to be controlled from a thermocouple 616 or other temperature sensing device which is placed in close proximity to the controlled heating elements such as between the circular heating elements 424. Thus, the controller 614 receives signals indicative of both the desired temperature and the actual temperature and selectively activates the heating elements 418 (424) to approximately maintain the actual temperature at the desired temperature. The output signal from the adder circuit 612 passes through a direct current meter 613 inserted between the adder circuit 612 and the controller 614. The meter 613 gives a visual indication of the desired temperature for the member to be controlled by the respective thermal control unit 600.

The controller 614 generates an output signal at an output 614A thereof. The output signal from the controller 614 selectively activates a solid state current valve 618 which in turn selectively drives the heating elements 418 (424) of the respective member to be controlled. The current valve 618 converts the low level output signal of the controller 614 to a high level signal capable of driving the heating elements.

The operation of the thermal control system shown in FIG. 6 will now be described with reference to the rotary cutter 106 shown in detail in FIGS. 4 and 5. The rotating knife 106A is set with the apparatus at rest so that the cutting surfaces 106C, 106D are in a cutting relationship and parallel to one another as previously described. The rotary cutter 106 can be set with no temperature bias, i.e., with the temperature of the vertical supports 400 at the ambient temperature. For no temperature bias, the potentiometers 608 are set to indicate no temperature increase for the heaters 418. This setting is indicated on the meter 613. In addition to a prebias temperature, the initial setting of the cutter can be simplified by making final precision adjustments by adjusting the temperature of one or both of the vertical supports 400. This could result in differential temperature settings between the individual heater elements which differential would be maintained throughout the operating speed range of the cutter.

The printing operation is started which activates the tachometer/generator 604. The corresponding output signal from the signal processing circuit 606 is added to the signals (if any) from the respective interface circuits 610 by the adder circuit 612. The output signal from the adder circuit 612 then reflects any prebias and/or differential setting as well as the operating speed of the rotary machine.

The output signal from the adder circuit 612 is passed to the controller 614 through the meter 613 and is interpreted by the controller 614 as a desired temperature setting for the vertical supports 400. The controller 614 also receives signals indicative of the actual temperature of the respective vertical support 400. If the desired temperature is higher than the actual temperature, the controller 614 opens the current valve 618 to activate the heating elements 418 (424) to heat the vertical supports 400. If the desired temperature is above the actual temperature, the controller 614 closes the current valve 618 to allow the vertical supports to cool to the desired temperature.

Thus, the thermal control system functions as a closed loop feedback control system to approximately maintain the actual temperatures of the vertical support elements 400 at the desired temperature so that the elements 400 change in length by an amount which is approximately equal to the change in length of the rotating knife 106A. Thus the temperatures of the elements 400 are coordinated or synchronized with the speed of rotation of the rotary cutter as determined by the tachometer/generator 604 to compensate for the centrifugal growth of the rotary blade 106A.

The rotary cutter 106 can also be adjusted with a prebias temperature, e.g., a preset elevated temperature applied to the vertical supports 400. Such prebias allows the effective length of the vertical supports 400 to not only be controlled in correspondence or synchronism with the speed of the apparatus but also to be decreased in length or "shrunk" to compensate for wear of the knives 106A and 106B by suitable control of one or more heating elements. For prebiased setting of the rotary cutter 106, the potentiometers 608 are set to a desired position corresponding to a predefined temperature which initially increases the length of the supports by a desired amount. The rotary cutter is then set as before. Such setting can lead to temperature differentials between the individual heaters in the various areas as previously mentioned. Prebiased temperature signals are generated by the interface circuits 610 in correspondence with the resistance presented by the potentiometers 608. The prebias temperature signals are passed to the controller 614 and can be read on the meter 613. The controller in turn controls the current valve 618 to approximately obtain the desired temperature as previously described.

It is important for prebiased setting of the cutter that the temperatures of the elements 400 not be permitted to fall below the prebiased temperature for start-up of the apparatus. Such a reduced temperature of the vertical supports 400 could lead to substantial contact and consequential damage to the cutting surfaces 106C and 106D of the rotary cutter 106. Also the rotary cutter 106 should never be stopped and powered down with the cutting surfaces of the fixed and rotary knives 106B, 106A above one another. Maintenance of the temperature is insured by providing power to the thermal control system shown in FIG. 6 and maintaining the positions of the potentiometers 608. Operation of the rotary cutter after prebias setting is essentially the same as previously described. As the system is operated, the signal from the tachometer/generator 604 controls the temperatures of the vertical supports 400 through the control circuits 600 in synchronism with the speed of rotation of the rotary cutter. If the knives show signs of wear, the setting of the potentiometers 608 can be reduced to compensate for that wear and to approximately restore the initial setting of the knives to maintain the quality of cut provided by the rotary cutter 106. Such adjustments for wear can be accomplished while the apparatus is operating simply by observing the quality of cut. Such adjustments are facilitated by the use of multiple turn potentiometers which allow for minute variations in the temperature control of the vertical support members 400.

A control system as shown in FIG. 6 can also be used to control the thermal heating elements 300, 302 of the printing press 102 in synchronism with its speed of operation. For application to the printing press, each of the current valves 618 must be selected to have a sufficiently high power rating to drive the three heating elements associated with one of the side frames 202, 204. Of course, if all three heating elements for a given side frame are driven by the same control unit 600, the individual control of each of the respective heating elements is impossible. For individualized control, additional control units 600 can be added to the thermal control system by connection into the output loop 606A of the signal processing circuit 606. Such additional control units 600 would be individually associated with one of the heating elements 300, 302. Similarly, control units could be added to control the heating elements 426 positioned on the rotating blade 106A of the rotary cutter 106.

A highly simplified thermal control unit can also be used for controlling the heaters in accordance with the present invention. Thus, a controller 614 and a current valve 618 could be provided for each heating element or group of heating elements used on a rotary machine. A selectable temperature dial located on the controller 614 could be calibrated to correspond to defined speeds of the rotary machine so that the setting of the machine could be adjusted for higher speeds by means of manual manipulation of the dial on the controller 614. In such a simplified thermal control system, a single control dial could be used with the controllers 614 gang-mounted to that dial. An initial differential setting between the temperatures of two elements, such as vertical supports 400 of the rotary cutter 106, could still be made to precisely adjust the setting of the rotary machine. After the initial setting was made, the two ganged controllers would be secured so that operation of the single dial would increase the temperature of the two vertical supports while maintaining the set temperature differential therebetween.

It is noted that each of the individual components used to construct the thermal control system shown in FIG. 6 is readily available commercially and easily connected in accordance with the present teachings by one of ordinary skill in the art.

Figure 7:
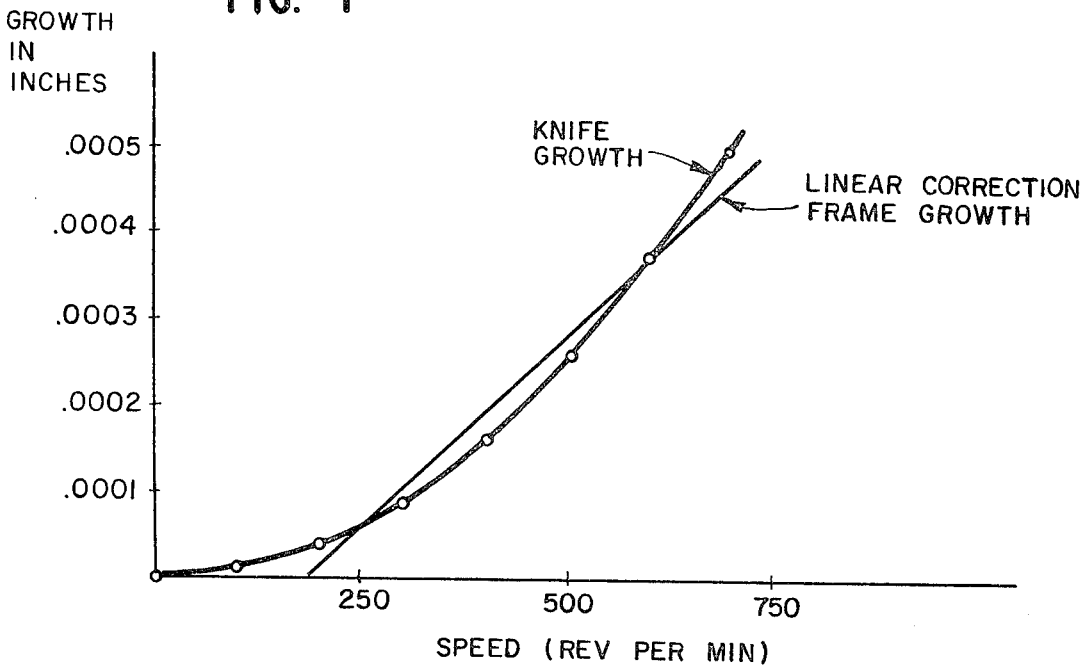
FIG. 7 is a graph comparing centrifugal growth of a rotating member to linear thermal correction for that growth.

FIG. 7 illustrates the rate of increase of the radial dimension of a rotating knife. The graph is based on a knife 11 inches across and growth in inches is plotted against speed of rotation in revolutions per minute. The plot of FIG. 7 illustrates that the increase is proportional to the square of the speed of rotation of the rotary knife. A linear correction as shown on FIG. 7 normally will satisfactorily correct for the growth due to centrifugal force, with a maximum deviation between the linear correction growth of the frame and the centrifugal growth of the rotary blade being approximately three one hundred thousandths (0.00003) of an inch.

It is possible, using commercially available equipment incorporated into the signal processing circuit 606, to generate an output signal which is linearly proportional to the square of the input signal from the tachometer generator 604. Even though such signal squaring equipment is more expensive, it can be used to control the growth of the support members in a rotary machine to even more closely track the growth of rotating members in applications where the added precision is necessary.

From the above description, it is apparent that an improved method and apparatus for the thermal adjustment of the setting between a first rotating member and a second fixed or rotating member has been described so that the setting between the members can be approximately maintained during variable and high speed operation of the rotary machine. From these teachings, alternate embodiments and modifications will be apparent to those skilled in the art. For example, a large variety of thermal control systems, utilizing known technology are possible, from sophisticated microprocessor systems to simplified potentiometer controllers. Also a large variety of thermal control elements, such as temperature controlled circulating liquids, refrigeration units, induction heaters and infrared heaters would be suitable for use in the present invention and may be preferred in certain designs of rotary machines. These alternate embodiments and modifications are considered to be within the true spirit and scope of the present invention.

What is claimed is:

1. A rotary cutter comprising:

first and second knife means each having at least one cutting surface;

frame means for supporting said first and second knife means with at least one of said knife means having a longitudinal axis spaced from its respective cutting surface and being mounted for rotation about said axis in said frame means, said first and second knife means being disposed and spaced relative to one another by spacing portions of said frame means so that material passing therebetween is severed at intervals defined by the speed of rotation of said rotating knife means and the speed of advancement of said material; and thermal adjusting means connected to said rotating knife means for controlling the temperature of the portion of said rotating knife means disposed between its axis of rotation and its cutting surface to set the spacing between said first and second knife means, said thermal adjusting means comprising heater elements and temperature monitoring means connected to said portion of said rotating knife means, means coupled to said temperature monitoring means for selectively activating said heater elements, and speed monitoring means for synchronizing the operation of said activating means with the speed of rotation of said rotating knife means.

2. A rotary cutter comprising:

first and second knife means each having at least one cutting surface;

frame means for supporting said first and second knife means with at least one of said knife means having a longitudinal axis spaced from its respective cutting surface and being mounted for rotation about said axis in said frame means, said first and second knife means being disposed and spaced relative to one another by spacing portions of said frame means so that material passing therebetween is severed at intervals defined by the speed of rotation of said rotating knife means and the speed of advancement of said material; and thermal adjusting means connected to said spacing portions of said frame means for controllng the temperature of said spacing portions to set the spacing between said first and second knife means, said thermal adjusting means comprising heater elements and temperature monitoring means connected to said spacing portions, means coupled to said temperature monitoring means for selectively activating said heater elements, and speed monitoring means for synchronizing the operation of said activating means with the speed of rotation of said rotating knife means.

3. A rotary cutter comprising:

first and second knife means each having at least one cutting surface;

frame means for supporting said first and second knife means with at least one of said knife means having a longitudinal axis spaced from its respective cutting surface and being mounted for rotation about said axis in said frame means, said first and second knife means being disposed and spaced relative to one another by spacing portions of said frame means so that material passing therebetween is severed at intervals defined by the speed of rotation of said rotating knife means and the speed of advancement of said material; and a first thermal adjusting means connected to said rotating knife means for controlling the temperature of the portion of said rotating knife means disposed between its axis of rotation and its cutting surface and a second thermal adjusting means connected to said spacing portions of said frame means for controlling the temperature of said spacing portions to set the spacing between said first and second knife means, said first thermal adjusting means comprising first heater elements and first temperature monitoring means connected to said portion of said rotating knife, means coupled to said first temperature monitoring means for selectively activating said first heater elements, and means for synchronizing the operation of said activating means with the speed of rotation of said rotating knife means, said second thermal adjusting means comprising second heater elements and second temperature monitoring means connected to said spacing portions, means coupled to said second temperature monitoring means for selectively activating said second heater elements, and means for synchronizing the operation of said activating means with the speed of rotation of said rotating knife means.

4. A method of operating apparatus for performing a desired operation on material passing therethrough, said apparatus comprising a frame having first and second support portions, an operating member mounted for rotation on said support portions, a cooperating member mounted on said support portions and disposed relative to said operating member so that said desired operation is performed on said material as it passes between said operating and cooperating members and said operating member is rotated, said method comprising:

(a) setting the position of said operating and cooperating members relative to said frame;

(b) fixing the position of said operating and cooperating members relative to said frame;

(c) rotating said operating member to perform said operation; and (d) adjusting the temperature of said first and second support portions to approximately maintain the setting between said operating and cooperating members of said apparatus, said step (d) comprising:

(e) monitoring the speed of rotation of said operating member;

(f) translating the speed of rotation of said operating member into a desired temperature for said first and second support portions;

(g) monitoring the temperature of said first and second support portions; and (h) controlling thermal elements mounted on said first and second support portions to maintain the temperatures of said support portions at approximately said desired temperature determined in step (f).

5. The method of claim 4 wherein step (a) comprises:

(i) controlling said thermal elements to obtain a preset temperature of said support portions;

(j) adjusting the setting between said operating and cooperating members at said preset temperature.

6. The method of claim 5 wherein step (a) further comprises:

(k) adjusting the temperature of at least one of said support portions to obtain a final setting between said operating and cooperating members; and (l) maintaining the temperature differential determined in step (k) throughout the temperature range corresponding to the operating speed range of said apparatus.

7. The method of claim 6 further comprising:

(m) reducing the preset temperature established in step (i) to approximately maintain the setting between the operating and cooperating members in said apparatus wherein said operating and cooperating members are subject to wear during operation of said apparatus.

* * * * *